US006903697B2

(12) United States Patent
Ogino

(10) Patent No.: US 6,903,697 B2
(45) Date of Patent: Jun. 7, 2005

(54) VEHICLE ANTENNA AND DIVERSITY RECEIVING APPARATUS

(75) Inventor: Kazushige Ogino, Hyogo (JP)

(73) Assignee: Fujitsu Ten Limited, Kobe (JP)

( * ) Notice: Subject to any disclaimer, the term of this patent is extended or adjusted under 35 U.S.C. 154(b) by 14 days.

(21) Appl. No.: 10/726,681

(22) Filed: Dec. 4, 2003

(65) Prior Publication Data

US 2004/0164913 A1 Aug. 26, 2004

(30) Foreign Application Priority Data

Dec. 6, 2002 (JP) ..... 2002-355848

(51) Int. Cl.[7] ..... H01Q 1/32

(52) U.S. Cl. ..... 343/713; 343/729; 343/853; 343/862

(58) Field of Search ..... 343/711–713, 729, 343/853, 862, 873

(56) References Cited

U.S. PATENT DOCUMENTS 5,049,892 A * 9/1991 Lindenmeier et al. ..... 343/713
6,236,372 B1 * 5/2001 Lindenmeier et al. ..... 343/713
6,400,334 B1 * 6/2002 Lindenmeier et al. ..... 343/850
6,603,434 B2 * 8/2003 Lindenmeier et al. ..... 343/713

FOREIGN PATENT DOCUMENTS

| | | |
|---|---|---|
| JP | A 5-63419 | 3/1993 |
| JP | A 5-63423 | 3/1993 |
| JP | B2 3175779 | 4/2001 |
| JP | A 2001-313508 | 11/2001 |
| JP | A 2002-510925 | 4/2002 |
| JP | A 2002-135024 | 5/2002 |

* cited by examiner

*Primary Examiner*—Shih-Chao Chen
(74) *Attorney, Agent, or Firm*—Oliff & Berridge, PLC

(57) ABSTRACT

Film antennas which are stuck to a front glass of a vehicle is of such a structure that a plurality of antenna elements are formed on a film substrates. Amplifiers are disposed at pillar parts, and in the vicinity of power supply points to the antenna elements grounding to a high-frequency component by high-frequency grounding members are carried out. The high-frequency grounding members can be fixed simply by sticking them on a coating film etc. for covering an exterior part of a vehicle body, and a work of peeling the coating film becomes unnecessary, and therefore, it is possible to easily carry out a work which comes up with antenna installation to a vehicle. Grounding to a direct current component is carried out, away from the power supply points through DC earth in the vicinity of a selector and a receiver.

9 Claims, 6 Drawing Sheets

VEHICLE ANTENNA AND DIVERSITY RECEIVING APPARATUS

BACKGROUND OF THE INVENTION

1. Field of the Invention

This invention relates to a vehicle antenna which is fixed to an exterior part of a vehicle body of a vehicle, and a diversity receiving apparatus which used the suchlike vehicle antenna.

2. Description of the Related Art

In order to be able to receive broadcasting radio waves and communication radio waves even in case that a vehicle such as an automobile is moving, various vehicle antennas have long been used so far. As an antenna which is fixed to a window glass etc. of a vehicle, a film antenna has been known (see, e.g., Japanese Patent No. 3,294,837). This film antenna is of such a structure that a plurality pairs of antenna elements are formed on a film substrate and an amplifier having a connector is connected to one end of the film substrate. It described that the film substrate and the amplifier are fixed to a rear glass of a vehicle, and an earth line due to the element is formed on the film substrate, and at the side of the amplifier, there is no necessity to connect earth to ground. It also discloses that a plurality sets of film antennas and amplifiers are provided, and by switching them, diversity reception is carried out. In passing, it is possible to electrically switch antennas (see, e.g., JP-T-2002-510925).

Also known is such a structure that an antenna pattern is directly formed on a window glass of an automobile, and a booster amplifier is disposed on a glass surface (see, e.g., Japanese Patent No. 3175779). Also, known is such a structure of an in-vehicle flat antenna that, on at least a part of a window glass plate of a vehicle, a conductor layer for radiating element, a dielectric layer, and a grounding conductive layer are sequentially formed from underneath, and a weak signal which is transmitted from a GPS satellite is received (see, e.g., JP-A-5-63423). Further, known is such a structure that a hole is opened in a ceiling board of a vehicle body, and an antenna and an amplifier for receiving a weak signal from a GPS satellite are fixed thereto (see, e.g., JP-A-5-63419).

As an antenna for use in receiving radio waves which is fixed to a vehicle, preferred is a film antenna which is used by being stuck to a window glass. In this regard, however, as explained in a column of the problem that the invention of the patent document 1 is to solve, there is a necessity of connecting earth to a vehicle body, which requires a work which is difficult for a general user to do. In the patent document 1, it is described that, since an earth line is formed on a film substrate and can be connected to an amplifier by a connector, it is possible to solve a problem which comes up with connection of earth. However, there is no description as to a reason that connection to earth is possible by simply connecting through the connector to the earth line which is formed together with an element on the film substrate which is stuck on a glass surface.

In case that an amplifier is disposed in the vicinity of an antenna, as to earth connection of the amplifier, there is a necessity of carrying out DC earth including a direct current component, to a vehicle body. A vehicle body itself of an automobile is of a conductive material such as metal etc., but, normally, it is painted with a coating material which is an electric insulation material. In order to carry out DC earth to the suchlike vehicle body, as a process to the vehicle body, there is a necessity of opening a hole in the vehicle body, and of carrying out earth connection by use of a bolt etc.

Considering processing workability, it is conceivable that an amplifier is not disposed in the vicinity of an antenna. In this regard, however, in this case, a power supply coaxial cable from the antenna to the amplifier is elongated, and there occurs deterioration of a S/N ratio as a signal-to-noise ratio of a high-frequency reception signal due to cable loss, and reception quality is deteriorated. Also, when length of the coaxial cable becomes longer, in particular, when impedance of the coaxial cable is not matched with impedance at a power supply point of the antenna, noises which are generated from a vehicle are induced on the coaxial cable for power supply, and the noises from the vehicle are induced on the coaxial cable for power supply, and deterioration of reception quality is invited.

SUMMARY OF THE INVENTION

An object of this invention relates to a vehicle antenna and a diversity receiving apparatus by which a work which comes up with antenna installation to a vehicle is easily carried out, and which can prevent deterioration of reception quality by carrying out appropriate earth connection.

This invention is a vehicle antenna which includes an antenna element which is fixed on a dielectric portion in an exterior part of a vehicle body, a high-frequency grounding member which is disposed in the vicinity of a power supply point of the antenna element and which is fixed to a conductive portion of the vehicle body so as to be capacitance-coupled for carrying out electric grounding with regard to a high-frequency component, and an amplifier which is disposed in the vicinity of the power supply point for amplifying a high-frequency reception signal which is inputted from the power supply point.

According to this invention, the vehicle antenna includes the antenna element, the high-frequency grounding member, and the amplifier. Since the antenna element is fixed to the dielectric portion in the exterior part of the vehicle body, by fixing it to a portion of electric insulation performance such as a window glass etc., it is possible to receive radio waves of a high-frequency signal by avoiding an electric influence of a metal vehicle body etc. Since the high-frequency grounding member is disposed in the vicinity of the power supply point of the antenna element and fixed to the dielectric portion of the vehicle body so as to be capacitance-coupled and electric grounding with regard to a high-frequency component is carried out, to the dielectric portion of the vehicle body in the vicinity of the antenna element, electric grounding is carried out to the high-frequency component, and it is possible to heighten reception capability of the antenna. Since the electric grounding is carried out by capacitance coupling, there is no necessity of realizing direct electric contact, and even if a conductive portion of the vehicle body is sufficiently painted with a coating material, a process for peeling the painting is unnecessary, and it is possible to easily connect to ground, and a work which comes up with antenna installation to a vehicle is easily carried out, and it is possible to prevent deterioration of reception quality by carrying out appropriate earth connection. Since the amplifier is disposed in the vicinity of the power supply point and amplifies the high-frequency reception signal which is inputted from the power supply point, even if it is a weak high-frequency reception signal which is received by the antenna element, it is possible to amplify it at a place which comes under the influence of noises which are generated in a vehicle and to prevent deterioration of reception quality.

Also, in this invention, the amplifier is directly connected to the power supply point and the high-frequency grounding member.

According to this invention, the amplifier is disposed closely to the power supply point to the antenna element and the high-frequency grounding member, which makes noises etc. difficult to be mixed in an input side of the amplifier, and thereby, it is possible to realize improvement of reception quality.

Also, in this invention, the amplifier is connected through a coaxial cable to the power supply point and the high-frequency grounding member.

According to this invention, since the power supply point to the antenna element and the high-frequency grounding member are connected through a coaxial cable to an input side of the amplifier, it is possible to easily select an installation position of the amplifier.

Also, in this invention, the amplifier outputs the amplified high-frequency reception signal through a coaxial cable, and in the vicinity of a portion in which the coaxial cable is connected to an in-vehicle unit for carrying out processing of the high-frequency reception signal, electric grounding with regard to a direct current component of the amplifier is carried out to the vehicle body.

According to this invention, electric grounding to a vehicle body with regard to the direct current component of the amplifier is carried out in the vicinity of a portion in which the coaxial cable is connected to an in-vehicle unit for carrying out processing of the high-frequency reception signal. The suchlike in-vehicle unit is disposed in a vehicle room etc., and it is possible to easily carry out electric grounding to a vehicle body.

Also, in this invention, a surface of the conductive portion of the vehicle body is covered with an electric insulation film, and the high-frequency grounding member is a metal thin plate member which is stuck on the electric insulation film.

According to this invention, by sticking the high-frequency grounding member to the exterior part of the vehicle body which is in such a state that it is covered with the electric insulation film, there occurs capacitance coupling with a conductive material through the electric insulation film, and it is possible to carry out electric grounding to the high-frequency component. It is possible to carry out grounding in such a situation that there is no necessity of peeling the electric insulation film, and a work is not troublesome, and there is no fear that corrosion resistance and beauty are lost.

Also, in this invention, a plurality of antenna elements are connected to the amplifier, and common grounding of a high-frequency portion with regard to the plurality of antenna elements is carried out to the high-frequency grounding member.

According to this invention, since it is possible to carry out, in common, grounding to the high-frequency component on the basis of capacitance coupling to a conductor part of a vehicle body due to the high-frequency grounding member to the plurality of antenna elements, it is possible to reduce fixing spots of the high-frequency grounding member, and to easily carry out a work which is required for fixing.

Also, in this invention, a switch for selecting an antenna element for amplifying a high-frequency reception signal, from the plurality of antenna element is built in the amplifier.

According to this invention, since the plurality of antenna elements are connected to amplifiers and an antenna element for amplifying the high-frequency signal can be selected by the switch, it is possible to easily carry out reception of different frequency bands by changing a shape of the antenna element, diversity reception by changing a location of the antenna element, and so on, and to select and transfer the reception signal from the plurality of antenna element, even in case that there is one signal line for deriving an output of the amplifier.

Further, this invention is a diversity receiving apparatus which includes a plurality of antenna elements which are fixed to a dielectric portion in an exterior part of a vehicle body and whose power supply points are disposed closely, a high-frequency grounding member which is disposed in the vicinity of the power supply points of the plurality of antenna elements and which is fixed to a conductive portion of the vehicle body so as to be capacitance-coupled for carrying out electric grounding in common with regard to a high-frequency component, an amplifier which is disposed in the vicinity of the power supply point for amplifying a high-frequency reception signal which is inputted from the power supply point, a switch which is disposed in the amplifier for selecting an antenna element for amplifying a high-frequency reception signal, and a selective reception unit for selecting an antenna element by which good reception quality with regard to the high-frequency reception signal is obtained by carrying out processing of the high-frequency reception signal which is amplified by the amplifier and by controlling the switch remotely.

According to this invention, the diversity receiving apparatus includes the plurality of antenna elements, the high-frequency grounding member, the amplifier, and the switch. The plurality of antenna elements are fixed to a dielectric portion in the exterior part of the vehicle body, e.g., on a window glass, and power supply points for connecting to a power supply line such as a coaxial cable etc. are disposed closely. The high-frequency grounding member is disposed in the vicinity of the power supply points of the plurality of antenna elements, and fixed to the dielectric portion of the vehicle body so as to be capacitance-coupled. Even if a conductive portion of the vehicle body is not made to be exposed, it is possible to easily carry out electric grounding with regard to the high-frequency component. Since the amplifier is disposed in the vicinity of the power supply point and amplifies the high-frequency reception signal which is inputted from the power supply point, mixture of noises etc. is reduced so that it is possible to heighten reception quality. Since the switch is disposed in the amplifier and selects an antenna element for amplifying the high-frequency reception signal, it is possible to carry out amplification of the high-frequency signal by use to one amplifier, to the plurality of antenna elements. Since the selective reception unit carries out processing of the high-frequency reception signal which is amplified by the amplifier and selects an antenna element by which good reception quality with regard to the high-frequency signal is obtained, by controlling the switch remotely, even if reception environment is changed along with movement of a vehicle, it is possible to continue reception by selecting an antenna element by which good reception quality is obtained.

Also, in this invention, combinations of the plurality of antenna elements and the amplifiers are disposed at different places of the exterior part of the vehicle body, respectively, and the selective reception unit carries out selection of the plurality of amplifiers and selection of an antenna element which is connected to the amplifier.

According to this invention, combinations of the plurality of antenna elements and amplifiers are disposed at different places of the exterior part of the vehicle body, and a place of the antenna is selected by selecting the amplifier, and further, the plurality of antenna elements which are disposed at a selected place are selected, and thereby, it is possible to configure in such a manner that good reception quality is obtained.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
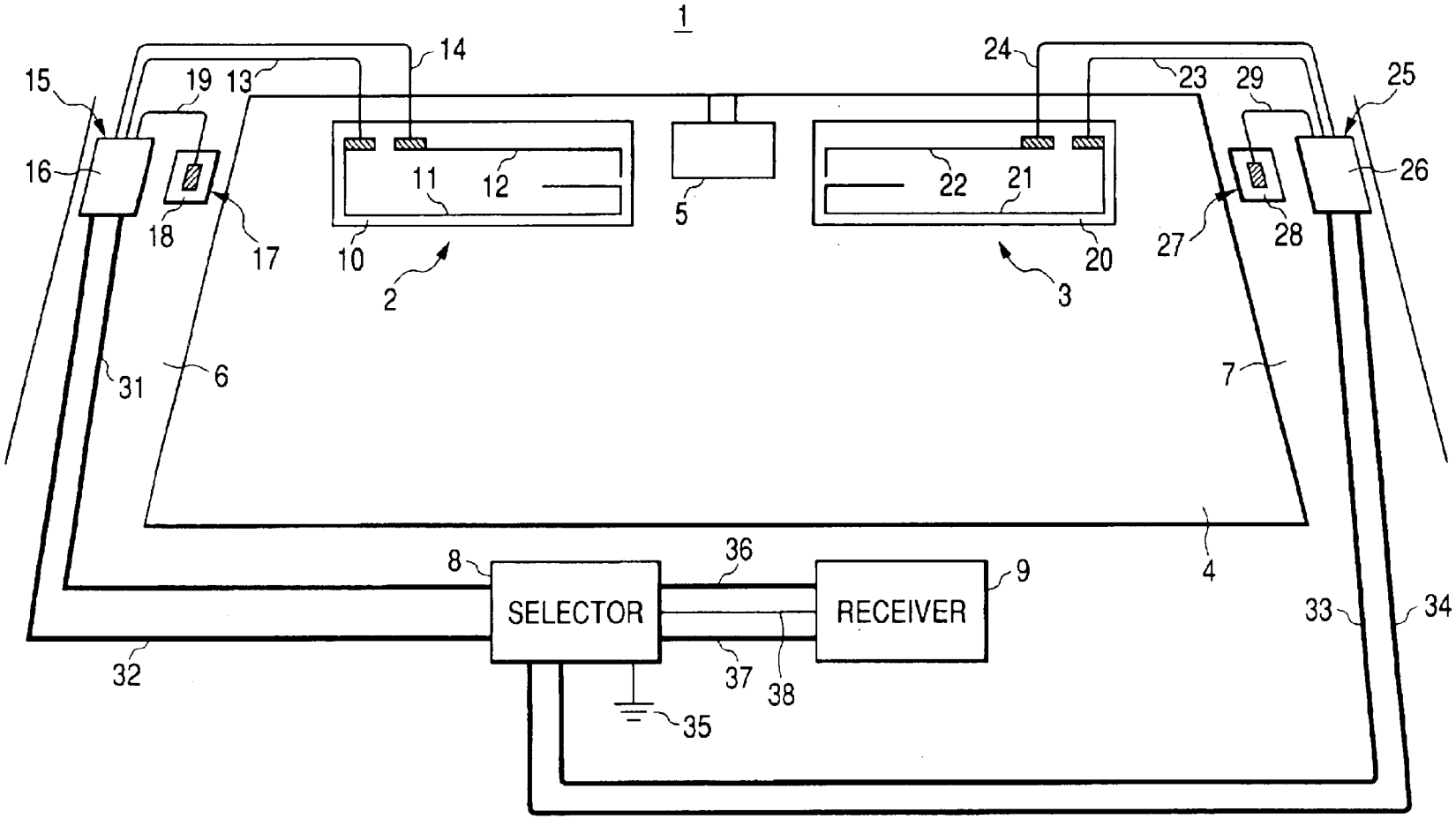
FIG. 1 is a block diagram showing a schematic electric structure of a vehicle antenna 1 which is one mode for carrying out this invention.

FIG. 1 shows a schematic electric structure of a vehicle antenna 1 which is one mode for carrying out this invention. In this embodiment, two film antennas 2, 3 are stuck to an inner surface of a front glass 4 of a vehicle of an automobile. The positions to which the film antennas 2, 3 were stuck are on a upper part of the front glass 4 and between a back mirror 5 and pillar parts 6, 7 at both sides thereof. An antenna element which is actually used for reception is selected by a selector 8, Selection by the selector 8 is switched by control of a receiver 9.

In one film antenna 2, on a surface of a film substrate 10 which is made by synthetic resin, a plurality of, for example, two antenna elements 11, 12 are formed. It is possible to form three and more antenna elements. Each antenna element 11, 12 is pulled out from a top of the front glass 4 through power supply lines 13, 14 to the pillar part 6 side, and connected to an input terminal of the amplifier 16 at the power supply point 15 which is disposed at the pillar part 6. At an input side of the amplifier 16, also carried out is grounding to a high-frequency component through a high-frequency grounding member 17. The high-frequency grounding member 17 has a metal foil 18, and the other end of a connection line 19 whose one end is connected to the metal foil 18 is connected to the input side of the amplifier 16 at the above-described power supply point 15. The metal film 18 carries out electric connection to the pillar part 6 by capacitance coupling.

Also, in the other film antenna 3, on a surface of a film substrate 20 which is made by synthetic resin, a plurality of, for example, two antenna elements 21, 22 are formed. Each antenna element 21, 22 is pulled out from a top of the front glass 4 through power supply lines 23, 24 to the pillar part 7 side, and connected to an input terminal of a amplifier 26 at a power supply point 25 which is disposed at the pillar part 7. At an input side of the amplifier 26, also carried out is grounding to a high-frequency component through a high-frequency grounding member 27. The high-frequency grounding member 27 has a metal foil 28, and the other end of a connection line 29 whose one end is connected to the metal foil 28 is connected to the input side of the amplifier 26 at the above-described power supply point 25. The metal film 28 carries out electric connection to the pillar part 7 by capacitance coupling.

The power supply points 15, 25 of the two film antennas 2, 3 are disposed on a upper part of the pillar parts 6,7, respectively. At the power supply points 15, 25, the amplifiers 16, 26 are disposed respectively. The amplifiers 16, 26 and the high-frequency grounding members 17, 27 are disposed on a back side of an interior material for covering surfaces of the pillar parts 6, 7, so as not to be seen from a room of a vehicle. The amplifiers 16, 26 includes two amplifying circuit which are connected to power supply lines 13, 14; 23, 24 from antenna elements 11, 12; 21, 22, respectively, and connected in common to the high-frequency grounding members 17, 27, respectively. An output from each amplifying circuit is inputted to the selector 8 through coaxial cables 31, 32, 33, 34. In the selector 8, outside conductors of the coaxial cables 31, 32, 33, 34 are directly connected to a vehicle body as DC earth 35. Also, the selector 8 selects one in the coaxial cables 31, 32, 33, 34 and connect it to a coaxial cable 36. The coaxial cable 36 is connected to the receiver 9 as well as control lines 37, 38 for controlling selection in the selector 8. The selector 8 and the receiver 9 are placed on a floor in a vehicle room, a trunk room and so on, and the DC earth 35 can be easily connected by use of a bolt etc. for fixing various units. Also, there may be such a case that the selector 8 is built in the receiver 9.

Figure 2:
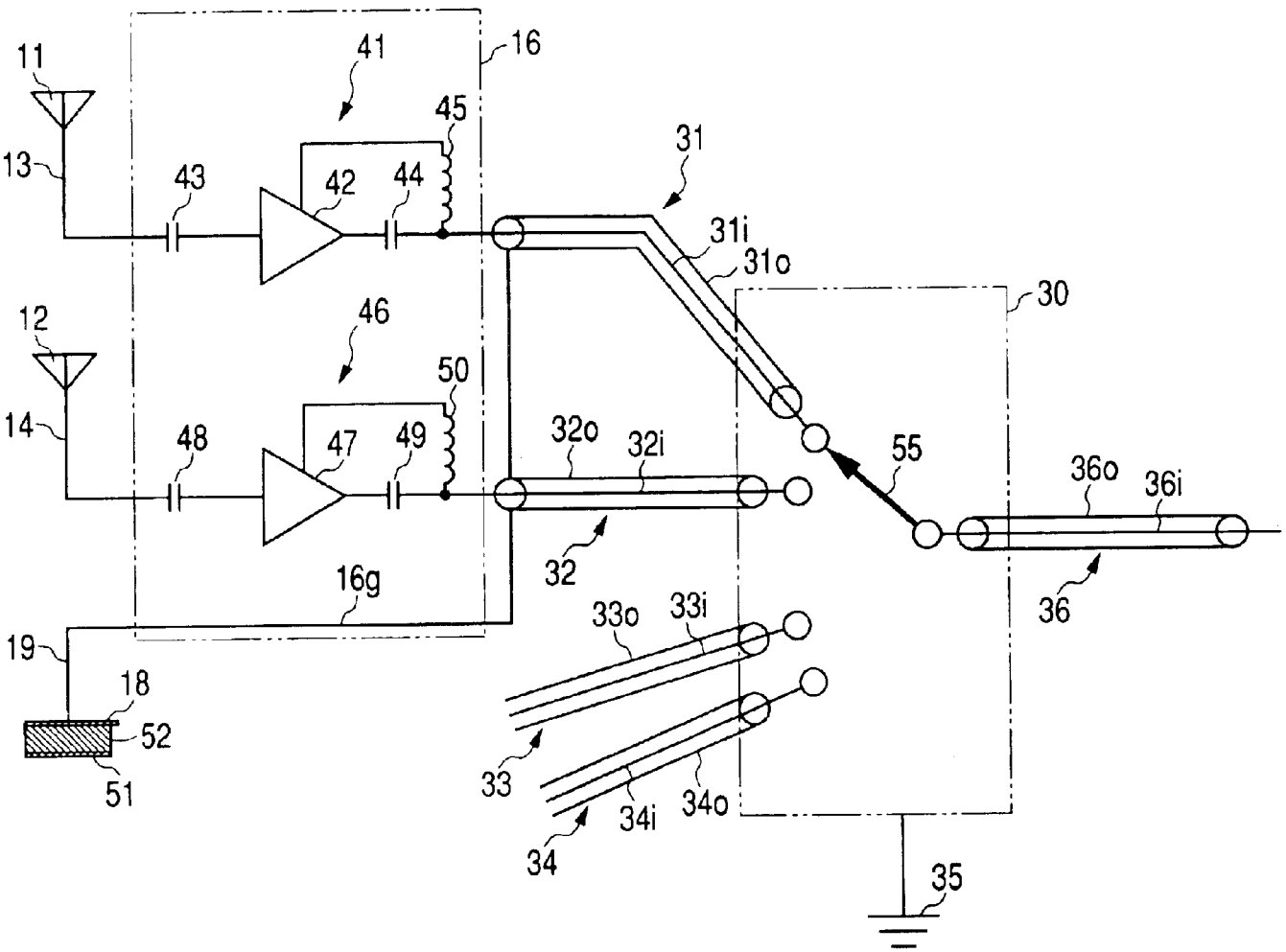
FIG. 2 is an electric circuit diagram of a portion which relates to an amplifier 16 of FIG. 1.

FIG. 2 shows an electric circuit structure which corresponds to the embodiment of FIG. 1. For convenience of explanation, a structure of one amplifier 16 side is mainly shown, but the other amplifier 26 side is equivalent thereto. In the amplifier 16, disposed is an amplifying circuit 41 whose input side is connected to the antenna element 11 through the power supply line 13. The amplifying circuit 41 has capacitors 43, 44 at an output side and an input side of an amplifier 42, and is separated to a direct current and low-frequency signal. In this regard, however, there may be such a case that feedback to the direct current and low-frequency signal is carried out through a coil 45. These internal structures are one example for aiming also to absolutely realize convenience for explanation, and there is no case that this invention is limited to this.

Also at the antenna element 12 side, an amplifying circuit 46 is disposed. A structure of the amplifying circuit 46 is essentially equivalent to the amplifying circuit 41, and an amplifier 47, capacitors 48, 49 and a coil 50 correspond to the above-described amplifier 42, capacitors 43, 44 and coil 45, respectively. Outputs of the amplifying circuits 41, 46 are connected to one ends of center core lines 31*i*, 32*i* of the coaxial cables 31, 32, respectively, and the other ends of the center core lines 31*i*, 32*i* are connected to a selector 30, respectively. Outside conductors 31*o*, 32*o* of the coaxial cables 31, 32 are connected in common to a grounding interconnection 16*g* of the amplifier 16. The grounding interconnection 16*g* is connected to the metal foil 18 of the high-frequency grounding member 17 through the connection line 19, The metal foil 18 carries out capacitance coupling by interposing a layer of an electric insulation coating film 52 between it and an electric conductive vehicle body 51. In the selector 8, a switch 55 is disposed, and it is switched so as to connect any one of center core lines 31*i*, 32*i*, 33*i*, 34*i* of the coaxial cables 31, 32, 33, 34 to a center core line 36*i* of the coaxial cable 36. Outside conductors 31*o*, 32*o*, 33*o*, 34*o*, 36*o* of respective coaxial cables 31, 32, 33, 34, 36 are connected in common to the DC earth 35.

Figure 3:
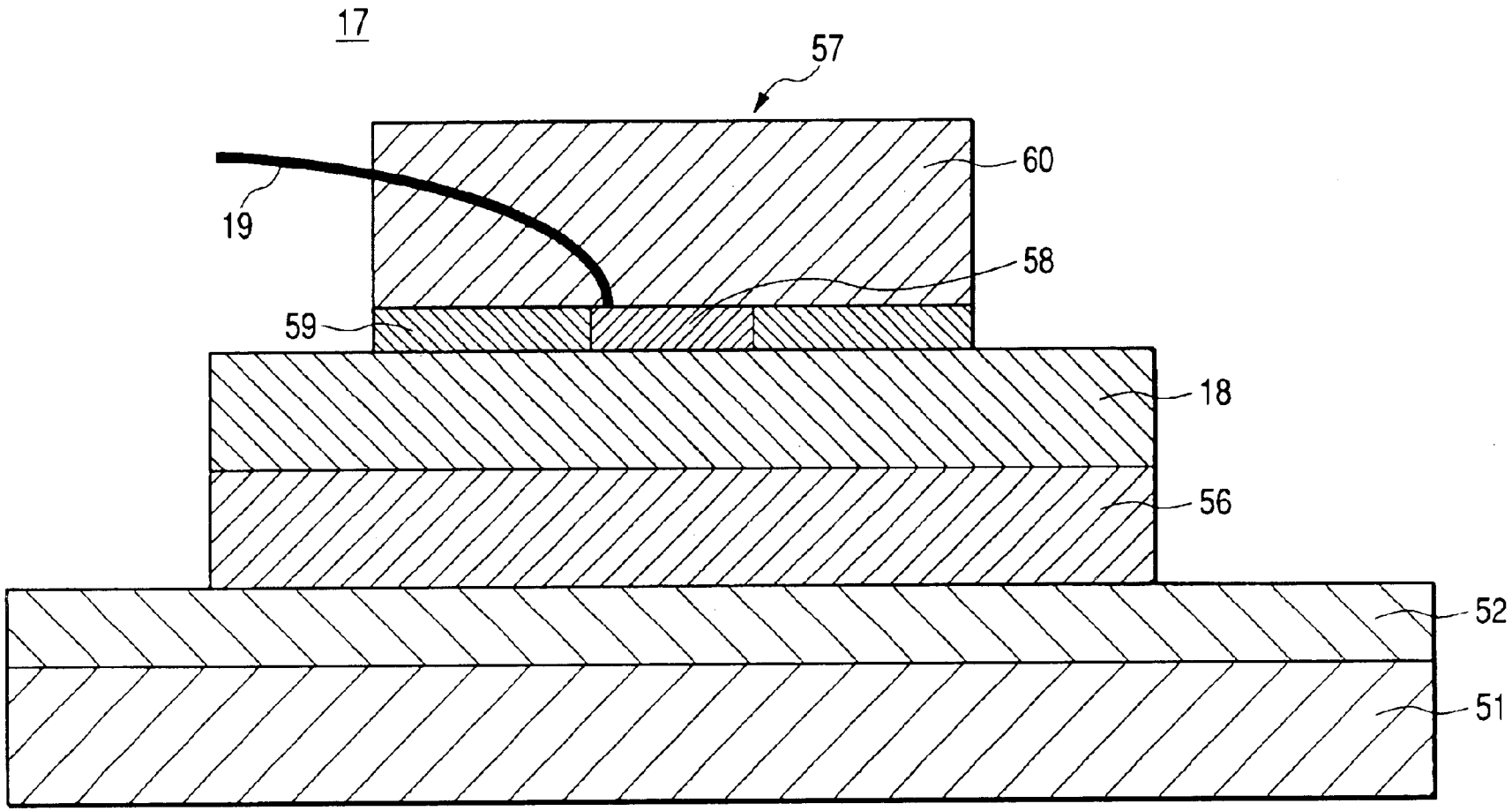
FIG. 3 is a cross sectional view showing a structure as to a fixing portion of a high-frequency grounding member 17 of FIG. 1.

FIG. 3 shows a cross sectional structure of the high-frequency grounding member 17. The high-frequency grounding member 27 shown in FIG. 1 also has an equivalent structure thereto. On the vehicle body 51 such as the pillar part 6 etc., the coating film 52 is formed with the purpose of improvement of anticorrosion and beauty. The coating film 52 is of electric insulation, and functions as a dielectric material which is interposed between the metal foil 18 and the vehicle body 51. That is, the metal foil 18 and the vehicle body 51 become electrodes of a capacitor which sandwich the coating film 52, and become of low impedance to a high-frequency signal, so that it is possible to carry out high-frequency earth.

The metal foil 18 is stuck on the coating film 52 by a sticky material 56. On the metal foil 18, a terminal 57 is formed, and electric connection to the connection line is carried out. In the terminal 57, a terminal conductive part 58 is fixed by being fitted into a cut hole of a two-sided tape 59, and further, an entirety is protected by being fixed with resin 60.

That is, a surface of the conductive portion of the vehicle body 51 is coated with an electric insulation film such as the coating film 52 etc., and the high-frequency grounding members 17, 27 are stuck on the coating film 52. Normally, by sticking the high-frequency grounding members 17, 27 to an exterior part of the vehicle body 51 which is in such a situation that a conductive material such as a steel material etc. is covered by the electric insulation film such as the coating film 52 etc., there occurs capacitance coupling between it and the conductive material through the electric insulation film, and it is possible to carry out electric grounding to the high-frequency component. It is possible to carry out grounding in such a situation that there is no necessity of peeling the electric insulation film, and a work is not troublesome, and there is no fear that corrosion resistance and beauty are lost. In this embodiment, since to secure earth in the vicinity of the antenna can be carried out by sticking the metal foil to a body coating surface, installation workability is dramatically improved. Also, since the amplifier is located in the vicinity of the antenna, deterioration of a S/N ratio due to cable loss is few, and also, since the coaxial cable and the amplifier are impedance-coupled, noise induction to the cable is few, and deterioration of reception quality is few.

As described above, the vehicle antenna 1 of this embodiment includes the antenna elements 11, 12; 21, 22 which are fixed to the front glass 4 which is a dielectric portion in the exterior part of the vehicle body, the high-frequency grounding members 17, 27 which are disposed in the vicinity of the power supply points 15, 25 of the antenna elements 11, 12; 21, 22 and fixed to the pillar parts 6, 7 which are conductive portions of the vehicle body so as to be capacitance-coupled for carrying out electric grounding with regard to a high-frequency component, and the amplifiers 16, 26 which amplify a high-frequency reception signal which is inputted from the power supply points 15, 25.

Since the antenna elements 11, 12; 21, 22 are fixed to the dielectric portion in the exterior part of the vehicle body, by sticking them to an electric insulation portion such as a front glass, a rear glass, a side glass, a roof glass and so on, it is possible to receive radio waves of a high-frequency signal by avoiding an electric influence of a metal vehicle body and so on. Since the high-frequency grounding members 17, 27 are disposed in the vicinity of the power supply points 15, 25 of the antenna elements 11, 12; 21, 22, and fixed to the conductive portion of the vehicle body so as to be capacitance-coupled and electric ground with regard to the high-frequency component is carried out, in the vicinity of the antenna elements 11, 12; 21, 22. To the conductive portion of the vehicle body, electric grounding to the high-frequency component is carried out, and it is possible to heighten a reception performance of the antenna. Since the electric grounding is carried out by capacitance coupling, there is no necessity of direct electric contact, and even if the conductive portion of the vehicle body is sufficiently painted with a coating material, a process for peeling the painting is unnecessary, and it is possible to easily connect to ground, and a work along with antenna installation to a vehicle is easily carried out, and it is possible to prevent deterioration of reception quality by carrying out appropriate earth connection. Since the amplifiers 16, 26 are disposed in the vicinity of the power supply points 15, 25 and amplify high-frequency reception signals which are inputted from the power supply points 15, 25, even if they are weak high-frequency reception signals which are received by the antenna elements 11, 12; 21, 22, it is possible to amplify them at a position in which it is difficult to come under the influence of noises which are generated in a vehicle, and to prevent deterioration of reception quality.

Also, the amplifiers 16, 26 are directly connected to the power supply points 15, 25 and the high-frequency grounding members 17, 27. By this, the amplifiers 16, 26 are located closely to the power supply points 15, 25 to the antenna elements 11, 12; 21, 22 and the high-frequency grounding members 17, 27, which makes noises etc. difficult to be mixed in an input side of the amplifier, and thereby, it is possible to realize improvement of reception quality.

Figure 4:
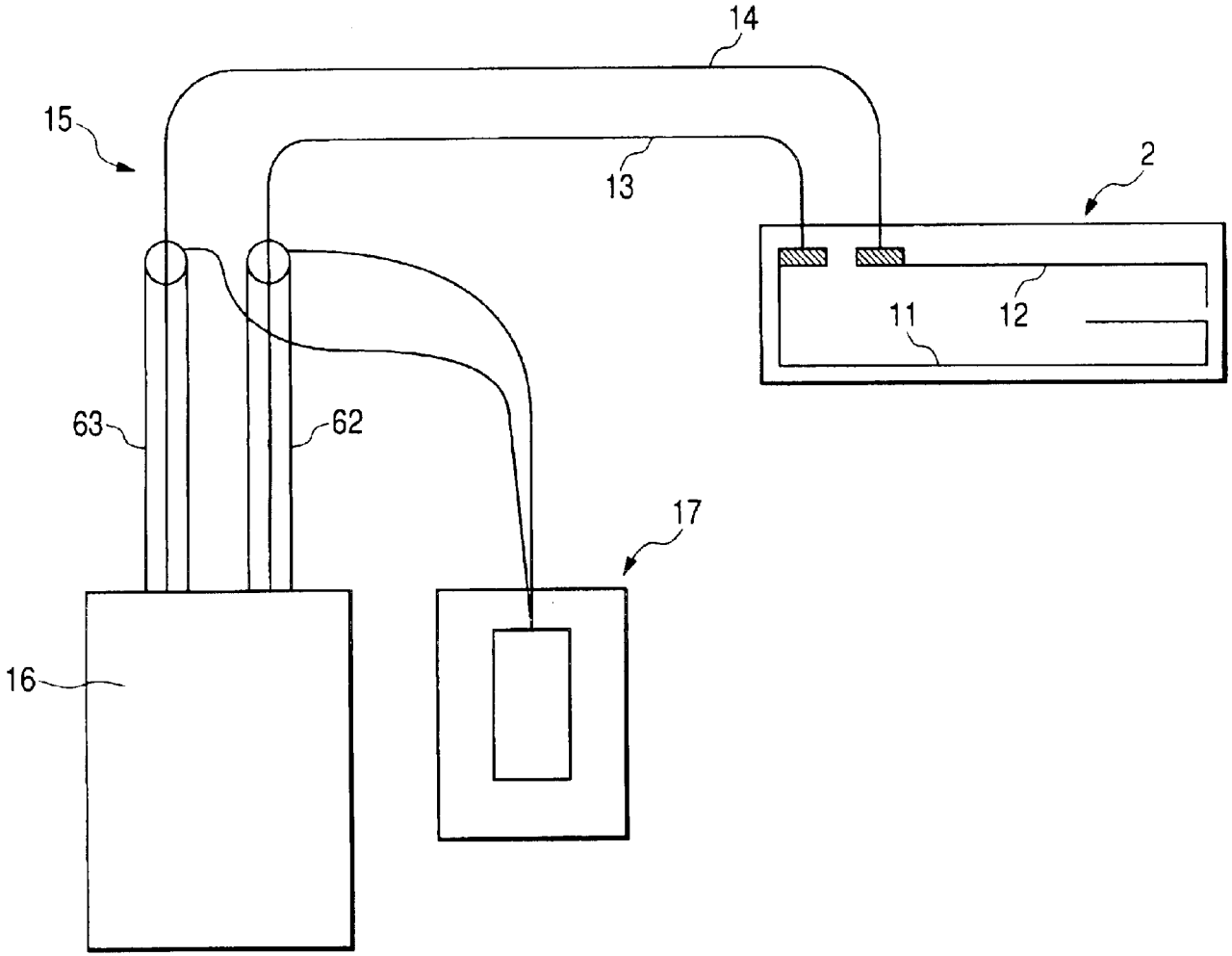
FIG. 4 is a block diagram showing a schematic electric structure of a vehicle antenna 61 which is another mode for carrying out this invention.

FIG. 4 shows a schematic electric structure of a vehicle antenna 61 which is another mode for carrying out this invention. In this embodiment, the same reference numerals and signs are given to portions which correspond to the embodiment of FIG. 1, and explanations to be overlapped will be omitted. Also, only one amplifier 16 side is shown and the other will be omitted, but as a matter of course, it has the same structure.

In this embodiment, the amplifier 16 is connected to the power supply lines 13, 14 at the power supply line 15 and the high-frequency grounding member 17 through coaxial cables 62, 63, respectively. To the power supply lines 13, 14, center core lines of the coaxial cables 62, 63 are connected, respectively, and to the high-frequency grounding member 17, outside conductors of the coaxial cables 62, 63 are connected in common.

Figure 5:
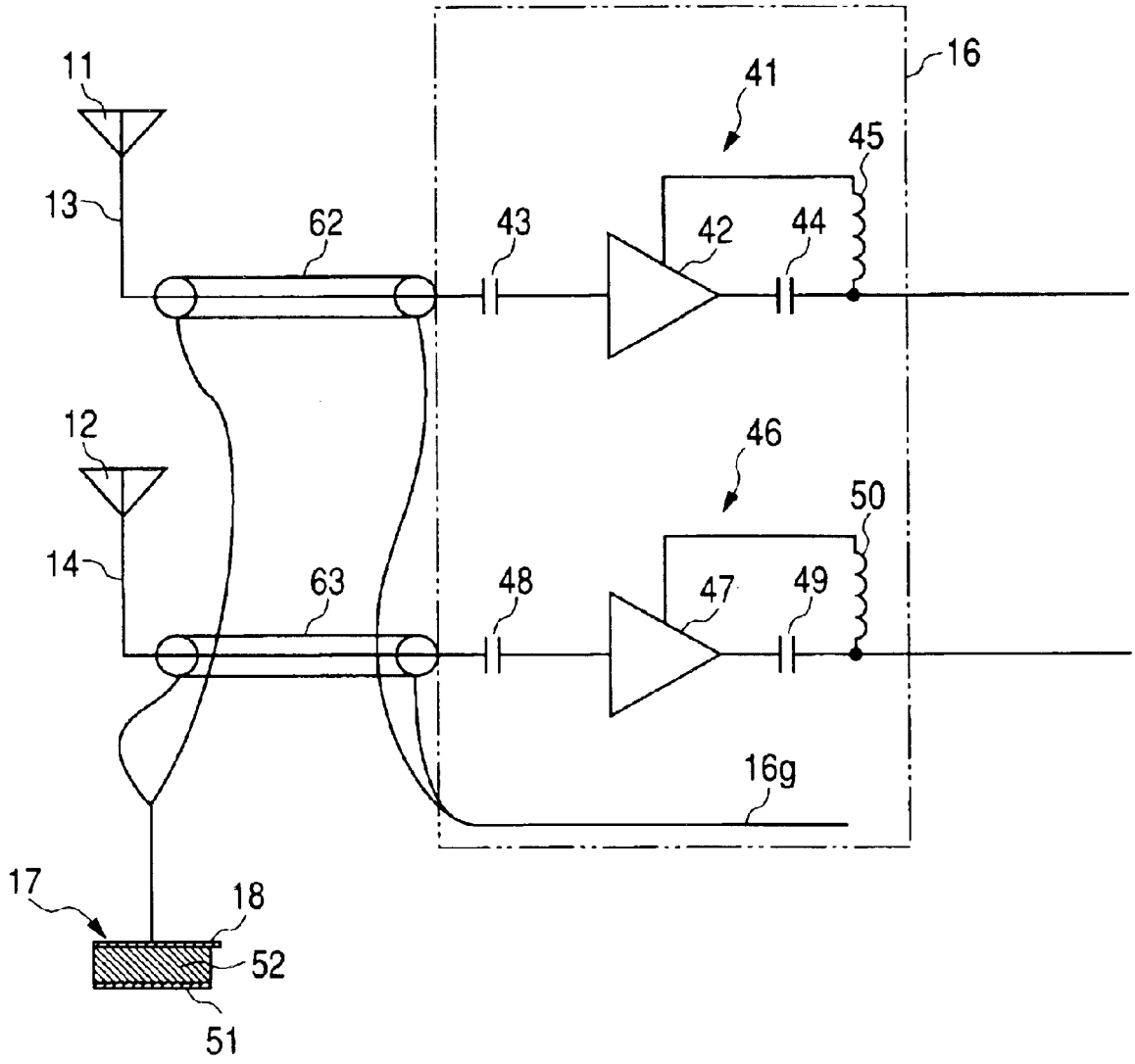
FIG. 5 is an electric circuit diagram of a portion which relates to an amplifier 16 of FIG. 4.

FIG. 5 shows an electric circuit structure of this embodiment. Center core lines 621, 631 of the coaxial cables 62, 63 are connected to input sides of amplifying circuits 41, 46, respectively. Outside conductors 62*o*, 63*o* of the coaxial cables 62, 63 are connected in common to the installation interconnection 16*g* of the amplifier 16. In this embodiment, since the power supply point 15 to the antenna elements 11, 12 and the high-frequency grounding member 17 are connected to an input side of the amplifier 16 through the coaxial cables 62, 63, it is possible to easily select an installation position of the amplifier 16.

Also, in the embodiments of FIGS. 1 and 4, the amplifiers 16, 26 output the amplified high-frequency reception signals through the coaxial cables 31, 32, 33, 34, and in the vicinity of such a portion that the coaxial cables 31, 32, 33, 34 are connected to a selector 30 and a receiver 40 as an in-vehicle unit for carrying out processing of the high-frequency reception signal, by the DC earth 35, electric grounding with regard to a direct current component of the amplifiers 16, 26 is carried out to the vehicle body. This is because the outside conductors 31*o*, 32*o*, 33*o*, 34*o* of the coaxial cables 31, 32, 33, 34 are connected in common to the DC earth 35. The electric grounding to the vehicle body with regard to the direct current component of the amplifiers 16, 26 is carried out in the vicinity of such a portion that an in-vehicle unit such as the selector 8 and the receiver 9 etc. for carrying out processing of the high-frequency reception signals which were amplified by the amplifiers 16, 26 is mounted on a vehicle, and the suchlike in-vehicle unit is located in a vehicle room etc., and it is possible to easily carry out electric grounding to the vehicle body.

Also, to the amplifiers 16, 26, a plurality of the antenna elements 11, 12; 21, 22 are connected, respectively, and to the high-frequency grounding members 17, 27, common grounding of the high-frequency component with regard to the plurality of antenna elements 11, 12; 21, 22 is carried out. Since grounding to the high-frequency component on the basis of capacitance coupling to a conductive part of the vehicle body 51 by the high-frequency grounding members 17, 27 to the plurality of antenna elements 11, 12; 21, 22 can be carried out in common, it is possible to reduce fixing spots of the high-frequency grounding members 17, 27, and to easily carry out a work which is required for fixing.

In passing, in the embodiments of FIGS. 1 and 4, the plurality of antenna elements 11, 12; 21, 22 are disposed on each film antenna 2, 3, but even if there is only one antenna element, it is of course to be able to obtain the above-described advantage. Also, as a matter of course, the film antennas 2, 3 may be one. On one hand, if the plurality of film antennas 2, 3 are used, and the plurality of antenna elements 11, 12; 21, 22 are disposed on each film antenna 2, 3, it is possible to carry out reception of diversity system by selective switching.

Figure 6:
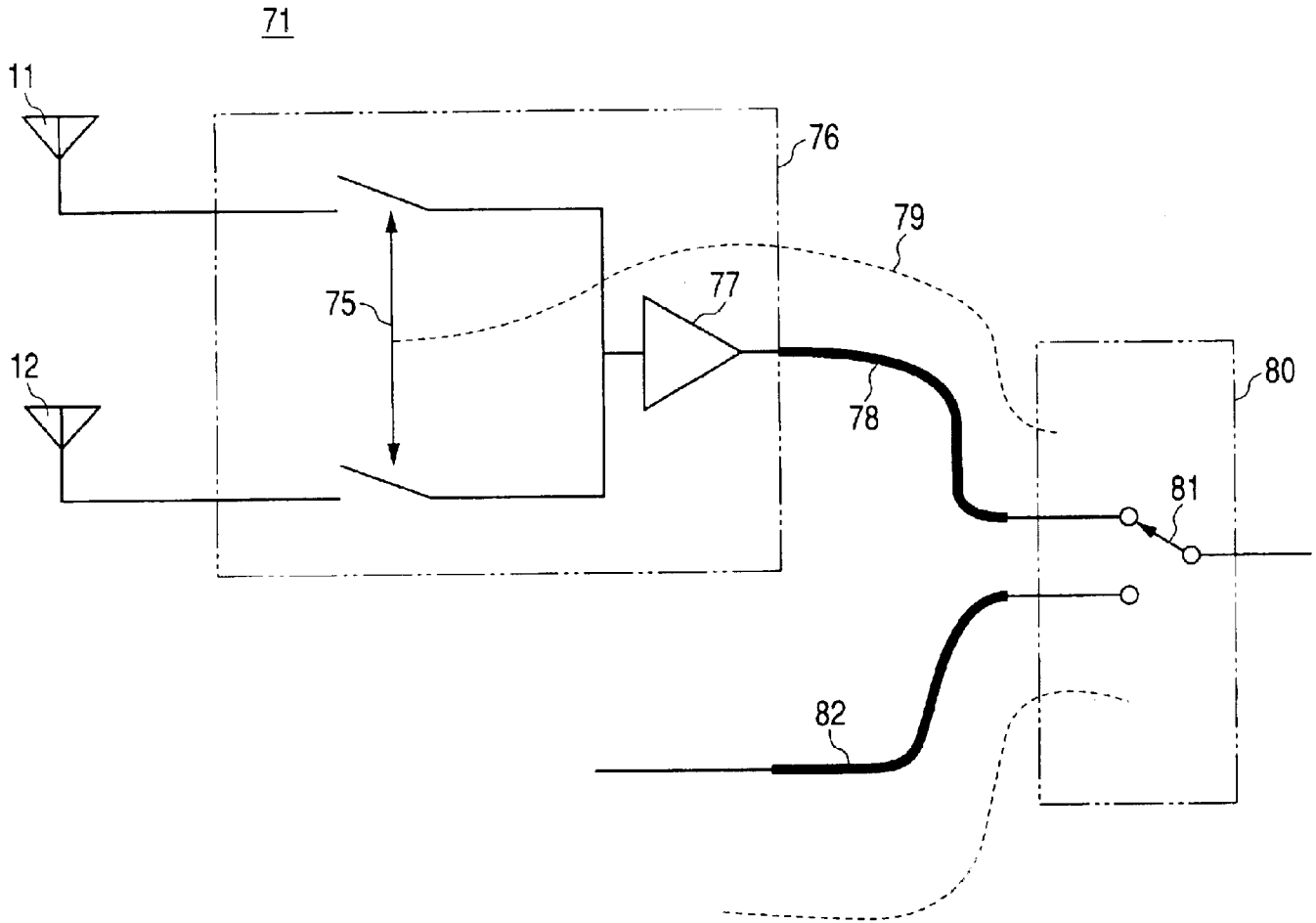
FIG. 6 is a partial electric circuit diagram of a vehicle antenna 71 which is still another mode for carrying out this invention.

FIG. 6 shows a schematic electric structure of a vehicle antenna 71 which can carry out reception of diversity system preferably as still another mode for carrying out this invention. In this embodiment, the same reference numerals and signs are given to portions which correspond to the embodiment of FIG. 1 or FIG. 4, and explanations to be overlapped will be omitted. Also, in this embodiment, only one structure at the antenna element 11, 12 sides is shown and the other antenna element 21, 22 sides will be omitted, but as a matter of course, it has substantially the same structure. In this embodiment, a switch 75 is built in an input side of an amplifier 76, and the power supply lines 13, 14 from the antenna elements 11, 12 are switched and amplified by an amplifying circuit 77, and it is possible to derive an amplified output to a coaxial cable 78. The coaxial cable 78 is connected to a selector 80 as well as a control line 79 for controlling switching of the switch 75. The selector 80 has a switch 81 and switches the coaxial cable 78 and a coaxial cable 82 from another amplifier so as to be inputted to the receiver 9 of FIGS. 1 and 4, and thereby, a diversity receiving apparatus is configured.

That is, in this embodiment, realized is a diversity receiving apparatus which includes a plurality of the antenna elements 11, 12 which are fixed to the front glass 4 etc. which is a dielectric portion in the exterior part of the vehicle body 51 and to which the power supply point 15 is disposed closely, the high-frequency grounding members 17 which is disposed in the vicinity of the power supply points 15 of the antenna elements 11, 12 and fixed to a conductive portion of the vehicle body 51 so as to be capacitance-coupled for carrying out electric grounding in common with regard to a high-frequency component, and the amplifiers 76 which is disposed in the vicinity of the power supply point 15 and which amplifies a high-frequency reception signal which is inputted from the power supply points 15, the switch 75 which is disposed in the amplifier 76 and which selects the antenna elements 11, 12 for amplifying the high-frequency reception signal, the selector 80 and receiver 9 as a selective reception unit for selecting the antenna elements 11, 12 by which good reception quality with regard to the high-frequency reception signal is obtained, by carrying out processing the high-frequency reception signal which is amplified by the amplifier 76 and by controlling the switch 75 remotely.

Since the suchlike diversity receiving apparatus has the same characteristic as in the above-described vehicle antennas 1, 61, and the switch 75 is disposed in the amplifier 76, and selects the antenna elements 11, 12 for amplifying the high-frequency reception signal, it is possible to carry out amplification of the high-frequency signal by one amplifier 76, to the plurality of antenna elements 11, 12. In the selector 80 and receiver 9 as the selective reception unit, since processing of the high-frequency reception signal which is amplified by the amplifier 76 is carried out, and the switch 75 is remotely controlled, and the antenna elements 11, 12 by which good reception quality with regard to the high-frequency reception signal is obtained is selected, even if reception environment is changed along with movement of a vehicle, it is possible to continue reception by selecting the antenna elements 11, 12 by which good reception quality is obtained.

Also, in this embodiment, the same combinations as the combinations of the plurality of antenna elements 11, 12 and the amplifier 76 are disposed in different places of the exterior part of the vehicle body 51, and the coaxial cables 78, 82 are switched by the switch 81 of the selector 80, and thereby, it is possible to carry out selection of the plurality of amplifiers and selection of antenna elements to be connected to the amplifier. By doing this, the combinations of the plurality of antenna elements and the amplifier are located at different places of the exterior part of the vehicle body 51, and a position of the antenna is selected by selecting the amplifier, and further, the plurality of antenna elements which are disposed at selected positions are selected, which enables good reception quality.

Also, as shown in FIG. 6, if the switch 75, which selects the antenna elements 11, 12 for amplifying the high-frequency reception signal, in the plurality of antenna elements 11, 12, is built in the amplifier 76, it is possible to utilize it as the diversity receiving apparatus as described above, and in addition, it is possible to easily carry out reception etc. of different frequency bands by changing a shape of the antenna elements 11, 12, and even if there is only one signal line for deriving an output of the amplifier, to select and transfer reception signals from the plurality of antenna elements 11, 12.

As above, according to this invention, by fixing an antenna element to a dielectric portion in an exterior part of a vehicle body, it is possible to carry out electric grounding with regard to a high-frequency component to a conductive portion of the vehicle body through a high-frequency rounding member from a portion which is in the vicinity of a power supply point of the antenna element. Since electric grounding is carried out by capacitance coupling, there is no necessity of realizing a direct contact, and even if the conductive portion of the vehicle body is sufficiently painted with a coating material, it is possible to electrically connect to ground, and therefore, it is possible to easily carry out a work which comes up with antenna installation to a vehicle, and to prevent deterioration of reception quality by carrying out appropriate earth connection. An amplifier is disposed in the vicinity of the power supply point, and even if a high-frequency reception signal which is received by the antenna element is weak, it is possible to amplify it at a position which is difficult to come under the influence of noises which are generated in a vehicle, and to prevent deterioration of reception quality.

Also, according to this invention, the amplifier is disposed closely to the power supply point to the antenna element and the high-frequency grounding member, and it is possible to prevent mixture of noises etc. and to realize improvement of reception quality.

Also, according to this invention, since the power supply point to the antenna element and the high-frequency grounding member are connected to an input side of the amplifier through a coaxial cable, it is possible to widen an interval of the amplifier and the power supply point to some extent, and it is possible to easily select an installation position of the amplifier.

Also, according to this invention, electric grounding to a vehicle body with regard to a direct current component of the amplifier is carried out in the vicinity of an installation position of an in-vehicle unit for carrying out processing of a high-frequency reception signal which was amplified by the amplifier. There are many cases that the in-vehicle unit is disposed in an inside of a vehicle, and it is possible to easily carry out electric grounding to the vehicle body.

Also, according to this invention, since it is possible to carry out electric grounding to a high-frequency component, by sticking the high-frequency grounding member to the exterior part of the vehicle body which is in such a situation that a conductive material is covered by an electric insulation film such as a coating film etc., it is possible to carry out grounding in such a situation that there is no necessity of peeling the electric insulation film, and a work is not troublesome, and there is also no fear that corrosion resistance and beauty are lost.

Also, according to this invention, since it is possible to carry out grounding to a conductive part of the vehicle body with regard to the high-frequency component, to the plurality of antenna elements, in common, it is possible to reduce fixing spots of the high-frequency grounding member, and to easily carry out a work which is required for fixing.

Also, according to this invention, it is possible to easily carry out reception of different frequency bands by changing a shape of the antenna element, diversity reception by changing a location of the antenna element, and so on, and to select and transfer the reception signal from the plurality of antenna elements, even in case that there is only one signal line for deriving an output of the amplifier.

Further, according to this invention, since the plurality of antenna elements are fixed to the dielectric portion in the exterior part of the vehicle body, and the high-frequency grounding member which was disposed in the vicinity of the power supply point of the plurality of antenna elements is fixed to the conductive portion of the vehicle body so as to be capacitance-coupled. The switch which is disposed in the amplifier selects an antenna element for amplifying the high-frequency reception signal, to the plurality of antenna element, it is possible to carry out amplification of a high-frequency signal by use of one amplifier. Since the switch is remotely controlled by the selective reception unit, and selects an antenna element by which good reception quality with regard to the high-frequency reception signal is obtained, even if reception environment is changed along with movement of a vehicle, it is possible to continue reception with good reception quality.

Also, according to this invention, since a plurality sets of combinations of the plurality of antenna elements and the amplifier are used, and located at different places of the exterior part of the vehicle body, a place of the antenna is selected by selecting the amplifier, and further, the plurality of antenna elements to be connected to the selected amplifier are selected, and it is possible to obtain good reception quality.

What is claimed is:

1. A vehicle antenna comprising:

an antenna element which is fixed to a dielectric portion in an exterior part of a vehicle body;

a high-frequency grounding member which is disposed in the vicinity of a power supply point of the antenna element and which is fixed to a conductive portion of the vehicle body so as to be capacitance-coupled for carrying out electric grounding with regard to a high-frequency component; and an amplifier which is disposed in the vicinity of the power supply point for amplifying a high-frequency reception signal which is inputted from the power supply point.

2. The vehicle antenna according to claim 1, wherein the amplifier is directly connected to the power supply point and the high-frequency grounding member.

3. The vehicle antenna according to claim 1, wherein the amplifier is connected to the power supply point and the high-frequency grounding member through a coaxial cable.

4. The vehicle antenna according to claim 1, wherein the amplifier outputs an amplified high-frequency reception signal through a coaxial cable, and in the vicinity of a portion in which the coaxial cable is connected to an in-vehicle unit for carrying out processing of the high-frequency reception signal, electric grounding with regard to a direct current component of the amplifier is carried out to the vehicle body.

5. The vehicle antenna according to claim 1, wherein a surface of the conductive portion of the vehicle body is covered with an electric insulation film, and the high-frequency grounding member is a metal thin plate member which is stuck on the electric insulation film.

6. The vehicle antenna according to claim 1, wherein a plurality of antenna elements are connected to the amplifier, and common grounding of a high-frequency portion with regard to the plurality of antenna elements is carried out to the high-frequency grounding member.

7. The vehicle antenna according to claim 6, wherein a switch for selecting an antenna element for amplifying a high-frequency reception signal, from the plurality of antenna element is built in the amplifier.

8. A diversity receiving apparatus comprising:

a plurality of antenna elements which are fixed to a dielectric portion in an exterior part of a vehicle body and whose power supply points are disposed closely;

a high-frequency grounding member which is disposed in the vicinity of the power supply point of the plurality of antenna elements and which is fixed to a conductive portion of the vehicle body so as to be capacitance-coupled for carrying out electric grounding in common with regard to a high-frequency component;

an amplifier which is disposed in the vicinity of the power supply point for amplifying a high-frequency reception signal which is inputted from the power supply point;

a switch which is disposed in the amplifier for selecting an antenna element for amplifying a high-frequency reception signal; and a selective reception unit for selecting an antenna element by which good reception quality with regard to the high-frequency reception signal is obtained by carrying out processing of the high-frequency reception signal which is amplified by the amplifier and by controlling the switch remotely.

9. The diversity receiving apparatus according to claim 8, wherein combinations of the plurality of antenna elements and the amplifier are disposed at different places of the exterior part of the vehicle body, respectively, and the selective reception unit carries out selection of the plurality of amplifiers and selection of an antenna element which is connected to the amplifier.

* * * * *